US006767229B1

(12) United States Patent
Wang

(10) Patent No.: US 6,767,229 B1
(45) Date of Patent: Jul. 27, 2004

(54) PROTECTIVE COVER AND ELECTRIC OUTLET ARRANGEMENT

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/352,980

(22) Filed: Jan. 29, 2003

(51) Int. Cl.[7] ..... H01R 13/44
(52) U.S. Cl. ..... 439/145
(58) Field of Search ..... 439/145, 143, 439/137–144, 136, 67

(56) References Cited

U.S. PATENT DOCUMENTS 6,537,089 B1 * 3/2003 Montague ..... 439/145
6,602,081 B1 * 8/2003 Wang ..... 439/145

* cited by examiner

*Primary Examiner*—Gary Paumen
(74) *Attorney, Agent, or Firm*—Rosenberg, Klein & Lee

(57) ABSTRACT

A protective cover and electric outlet arrangement includes an outlet body, the outlet body having a socket unit with insertion holes for receiving an electric plug, a protective cover coupled to the outlet body and moved between an open position to open the insertion holes of the socket unit and a close position to close the insertion holes of the socket unit, and a locking structure adapted to selectively lock the protective cover in the open position or the close position, the locking structure includes a notch in the outlet body, two notches in the protective cover, and a locking member pivoted to the notch of the outlet body and turned between the locking position and the unlocking position to selectively engage the notches of the protective cover.

5 Claims, 19 Drawing Sheets

PROTECTIVE COVER AND ELECTRIC OUTLET ARRANGEMENT

BACKGROUND OF THE INVENTION

1. Field of the Invention

The present invention relates generally to electric sockets and, more specifically, to a protective cover and electric outlet arrangement, which has locking means to selectively lock the protective cover in the close position or the open position.

2. Description of the Related Art

FIG. 1A illustrates an electric outlet 1 constructed according to the prior art. This structure of electric outlet 1 comprises a plurality of socket units 110 connected in series, and a plurality of protective covers 120 for selectively closing the socket units 110. Because the protective covers 120 are small members detachably fastened to the socket units 110 by a plug joint, they must be carefully received in place when removed from the electric outlet 1.

FIG. 1B shows another prior art design, which was invented by the present inventor. According to this design, the cover plates 12 are coupled to the electric outlet 1, and movable relative to the respective socket units 11 between the open position and the close position.

FIGS. 2A, 2B, and 2C show still another prior art design. According to this design, the electric socket is comprised of a socket body 13, a protective cover 14, and a torsional spring 15. The protective cover 14 has insertion slots 141 corresponding to the insertion slots 131 of the socket body 13. The torsional spring 15 is connected between the socket body 13 and the protective cover 14 to support the protective cover in an offset position. The insertion slots 131 of the socket body 13 each have a sloping end edge 132. When inserting the contact blades of an electric plug 16 into the insertion slots 141, the contact blades of the electric plug 16 are moved along the sloping end edges 132, and at the same time the protective cover 14 is forced to move in one direction, for enabling the contact blades of the electric plug 16 to be inserted into the inside of the insertion slots 131 of the socket body 13. When removed the electric plug 16 from the socket body 13, the torsional spring 15 immediately pushes the protective cover 14 back to its former position. This design has drawbacks. Because the insertion slots 131 of the socket body 13 are not closed after removal of the electric plug 16, dust tends to pass from the outside air through the insertion slots 141 of the protective cover 14 and the insertion slots 131 of the socket body 13 into the inside of the socket body 13. Further, a child can easily insert a scissors, screwdriver, clip, or any of a variety of long elements into the insertion slots 141 of the protective cover 14 and the insertion slots 131 of the socket body 13 to contact the internal power contacts of the socket body 13, causing an electric shock.

FIGS. 3A and 3B still another prior art design. According to this design, the protective cover 17 is a circular member fastened pivotally with the electric outlet, and a spring member 18 is connected between the electric outlet and the protective cover 17 to support the protective cover in the close position where the insertion slots 171 of the protective cover 17 are at an offset position relative to the insertion slots 19 of the corresponding socket unit of the electric outlet. When in use, the user must rotate the protective cover 17 from the close position to the open position, for enabling the contact blades of an electric plug to be inserted into the insertion slots 171 of the protective cover 17 and the insertion slots 19 of the corresponding socket unit of the electric outlet. Because the protective cover is fastened pivotally with the electric outlet, a child can easily rotate the protective cover to the open position and then insert a metal object into the insertion slots 19 of the corresponding socket unit of the electric outlet.

Therefore, it is desirable to provide a protective cover and electric outlet arrangement that eliminates the aforesaid drawbacks.

SUMMARY OF THE INVENTION

The present invention has been accomplished under the circumstances in view. It is the main object of the present invention to provide a protective cover and electric outlet arrangement, which has lock means to selectively lock the protective cover in the close position or the open position. According to one aspect of the present invention, the protective cover and electric outlet arrangement comprises an outlet body, the outlet body having a socket unit with insertion holes for receiving an electric plug, a protective cover coupled to the outlet body and moved between an open position to open the insertion holes of the socket unit and a close position to close the insertion holes of the socket unit, and a locking structure adapted to selectively lock the protective cover in the open position or the close position, the locking structure includes a notch in the outlet body, two notches in the protective cover, and a locking member pivoted to the notch of the outlet body and turned between the locking position and the unlocking position to selectively engage the notches of the protective cover. In one embodiment of the present invention, the protective cover is coupled to the outlet body and moved linearly between the close position and the open position. In another embodiment of the present invention, the protective cover is fastened pivotally with the outlet body and rotated between the close position and the open position. The locking structure comprises a locking member, which can be a bolt fastened pivotally with the outlet body, a locking latch coupled to the outlet body, or a seesaw switching lever pivoted to the outlet body. Alternatively, the locking member can be installed in the protective cover.

DETAIL DESCRIPTION OF THE INVENTION

Figure 1A:
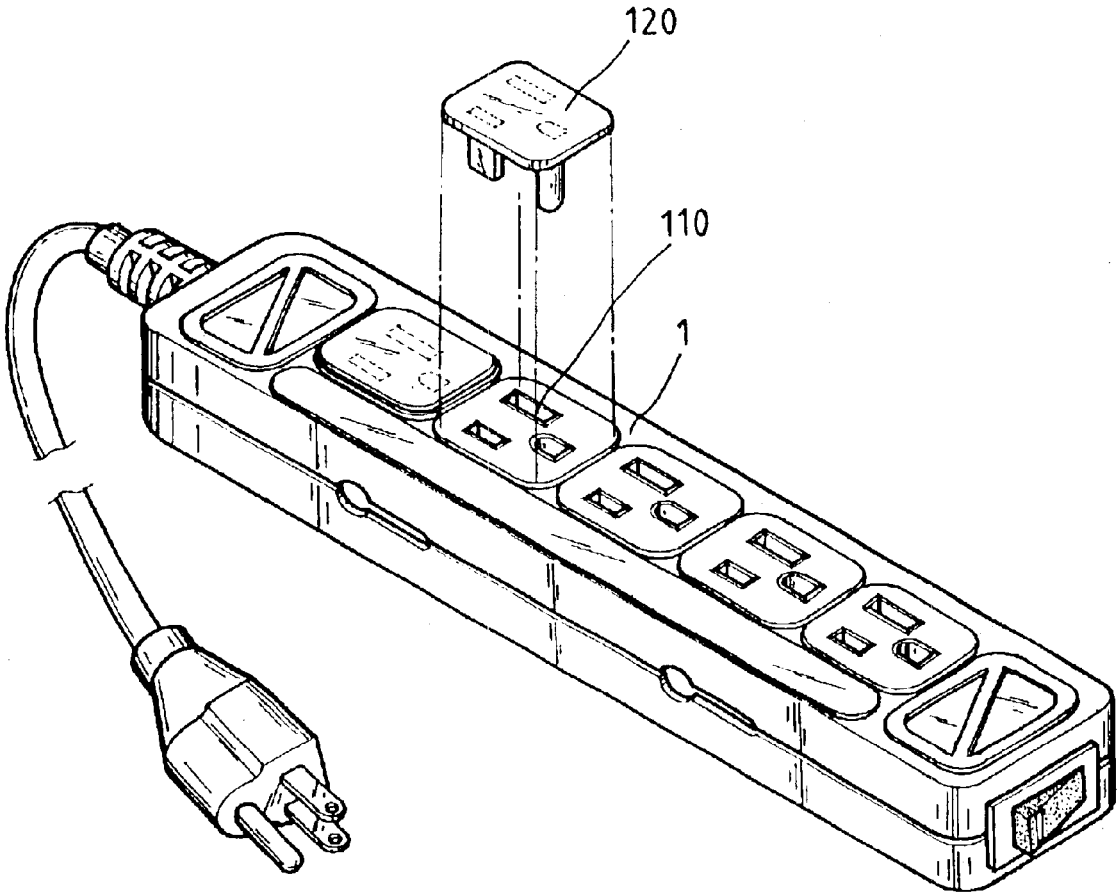
FIG.1(A) PRIOR ART
FIG. 1A is an exploded view of a protective cover and electric outlet arrangement according to the prior art.
Figure 1B:
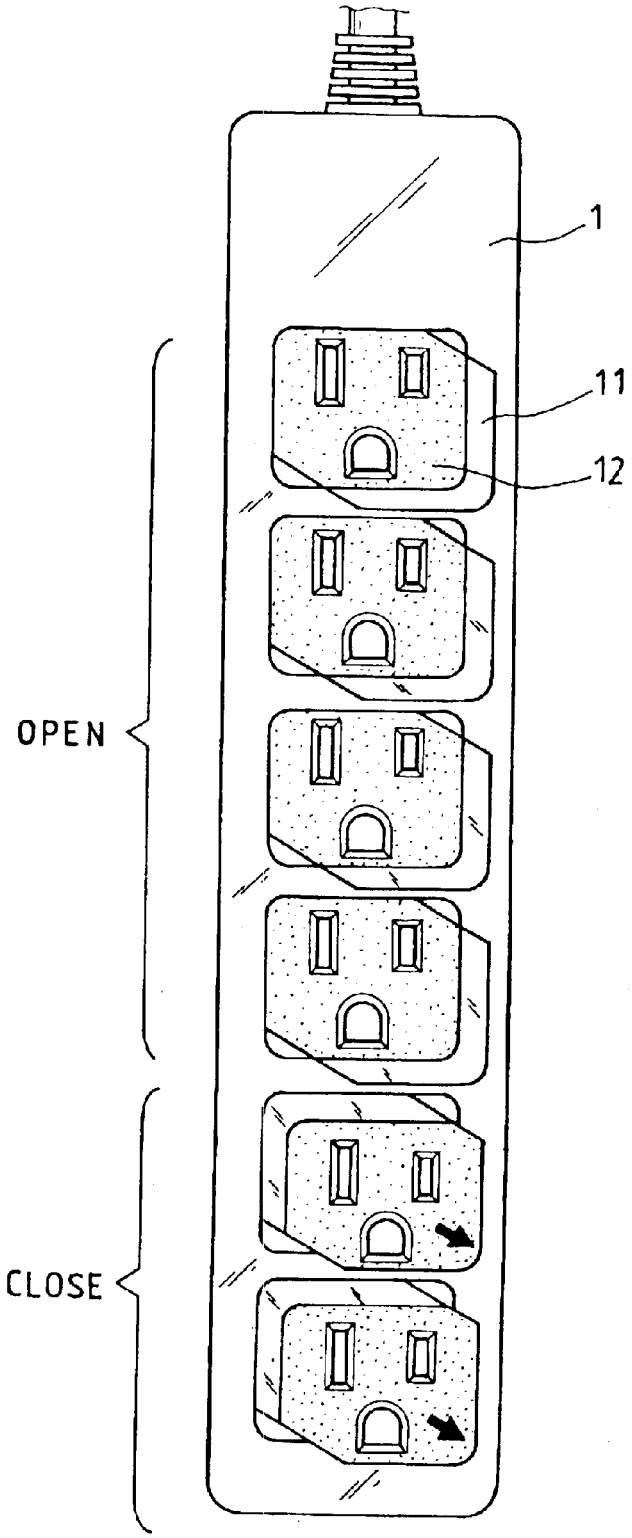
FIG.1(B) PRIOR ART
FIG. 1B is a top view of another design of protective cover and electric outlet arrangement according to the prior art.
Figure 2A:
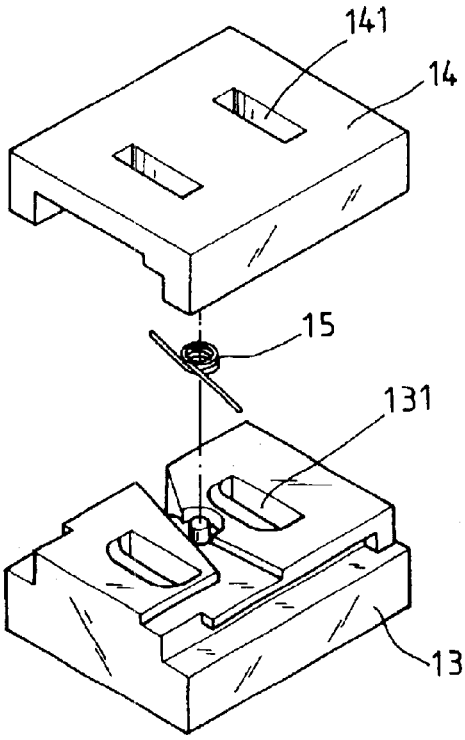
FIG. 2(A) PRIOR ART
FIG. 2A is an exploded view of still another design of protective cover and electric outlet arrangement according to the prior art.
Figure 2B:
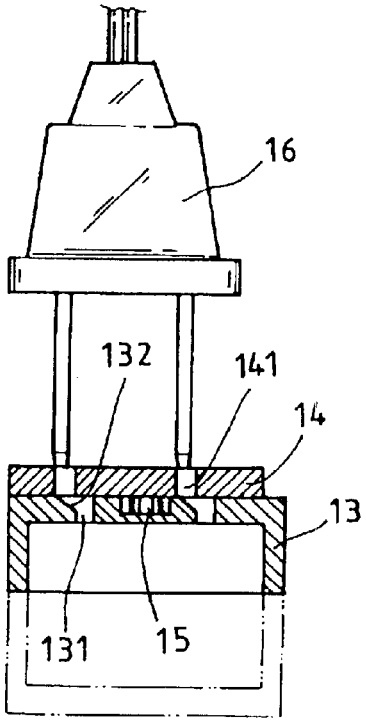
FIG. 2(B) PRIOR ART
FIG. 2B is a schematic drawing shown an application of the design of FIG. 2A.
Figure 2C:
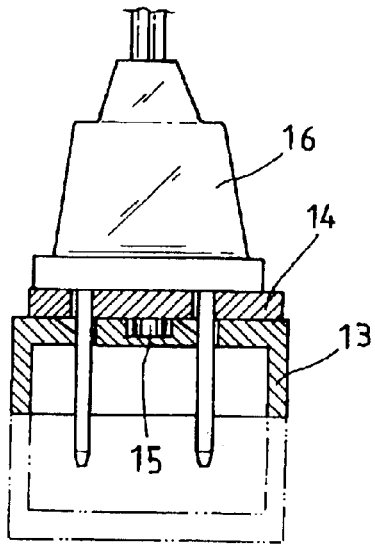
FIG.2(C) PRIOR ART
FIG. 2C is similar to FIG. 2B but showing the electric plug installed.
Figure 3A:
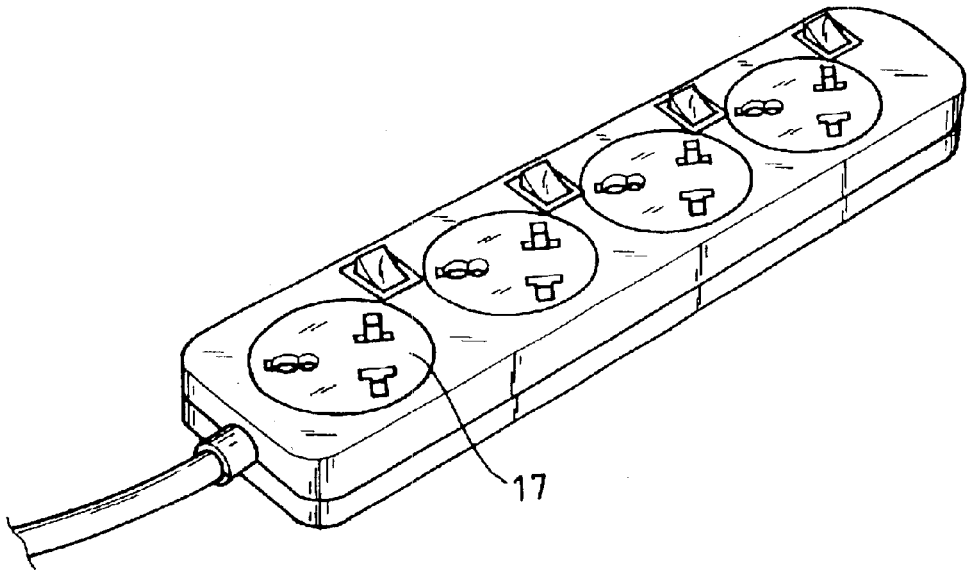
FIG. 3(A) PRIOR ART
FIG. 3A is an elevational view of still another design of protective cover and electric outlet arrangement according to the prior art.
Figure 3B:
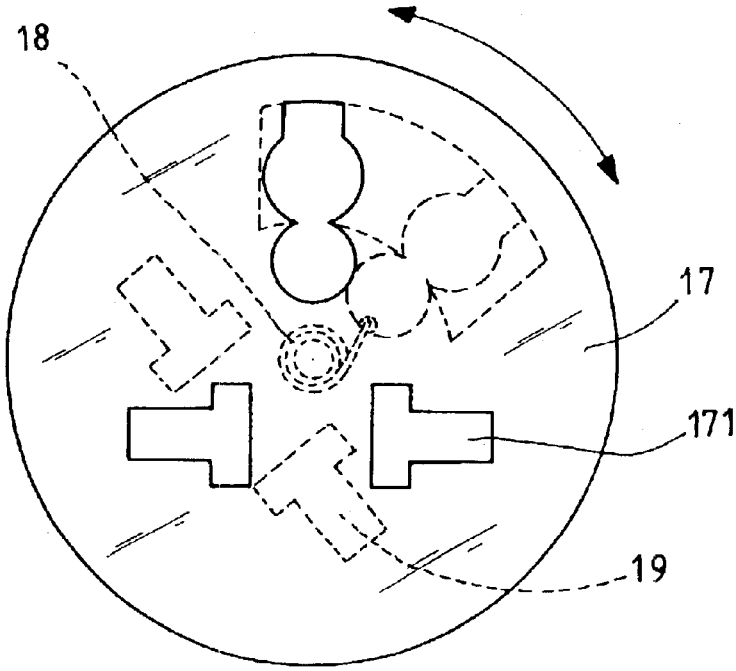
FIG. 3(B) PRIOR ART
FIG. 3B is a schematic top plain view showing the operation of the prior art design of FIG. 3A.
Figure 4:
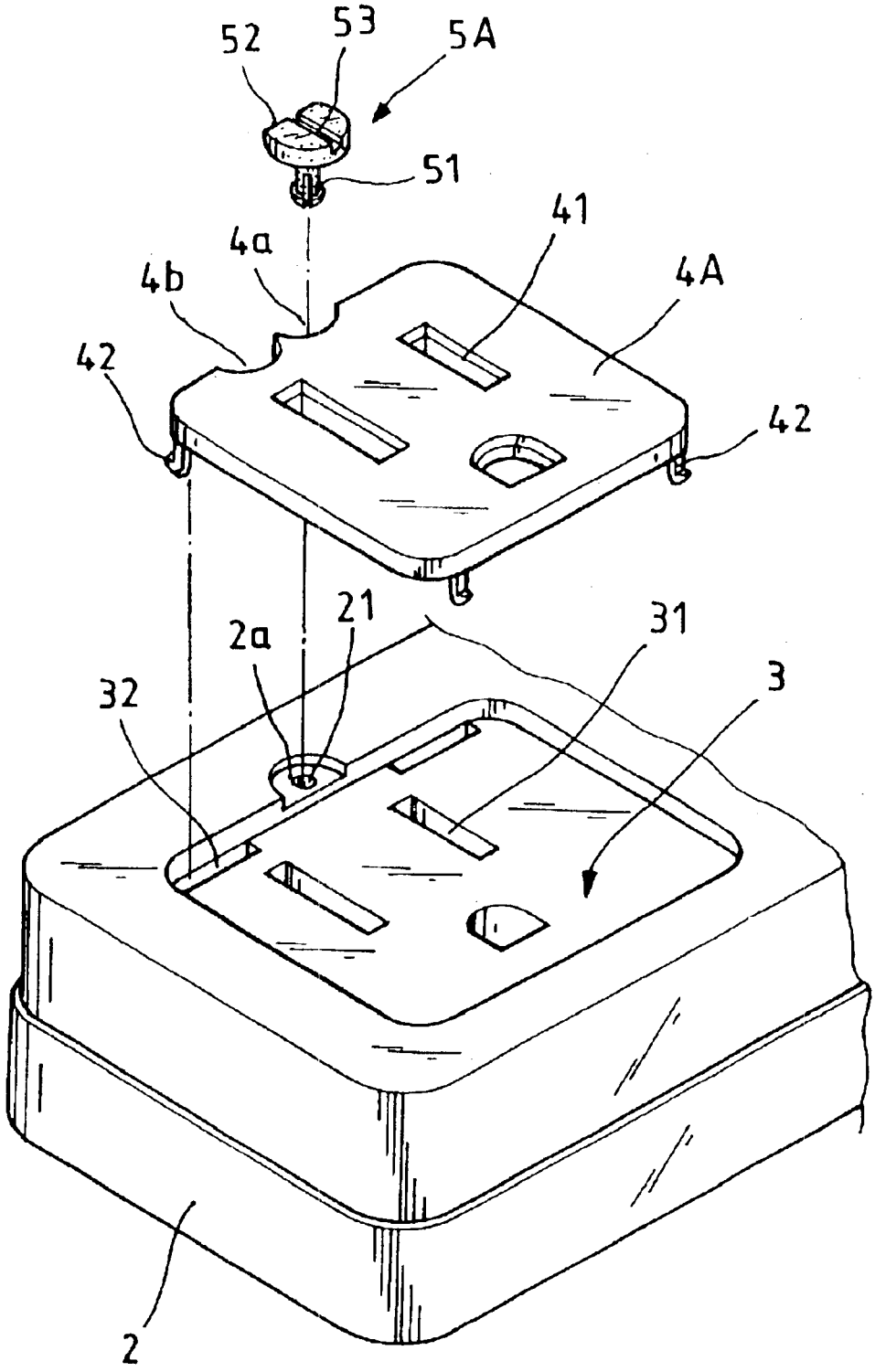
FIG. 4 is an exploded view of a protective cover and electric outlet arrangement according to the present invention.

As shown in FIG. 4, a protective cover and electric outlet arrangement in accordance with the present invention is shown comprising an outlet body 2. The outlet body 2 comprises at least one socket unit 3. Each socket unit 3 has a plurality of insertion slots 31 in the top wall for receiving an electric plug. Each socket unit 3 is covered with a respective cover 4A, which has a plurality of insertion slots 41 corresponding to the insertion slots 31 of the socket unit 3. The protective cover 4A can be moved between an open position where the insertion slots 41 of the protective cover 4A are respectively aimed at the insertion slots 31 of the corresponding socket unit 3, and a close position where the insertion slots 41 of the protective cover 4A and the insertion slots 31 of the corresponding socket un 3 are set off, preventing insertion of an electric plug into the socket unit 3.

Each socket unit 3 has a plurality of sliding slots 32 symmetrically arranged in the top wall. The cover plate 4A has a plurality of hooked springy legs 42 symmetrically and downwardly extended from the bottom wall and respectively hooked in the sliding slots 32 for enabling the protective cover 4A to be moved between the open position and the close position. In order to lock the protective cover 4A in the close position or open position, a locking structure is provided in each socket unit 3 and the corresponding protective cover 4A. The locking structure comprises a notch 2*a* in the top side of the respective socket unit 3, a locating hole 21 in the notch 2*a*, a first notch 4*a* and a second notch 4*b* in one peripheral side of the protective cover 4A, and a locking bolt 5A for locking the protective cover 4A in the close or open position. The locking bolt 5A has a head 53, and a flanged split shank 51 perpendicularly extended from the center of the bottom side of the head 52. The head 53 has a cut edge 52 in the periphery.

Figure 4A:
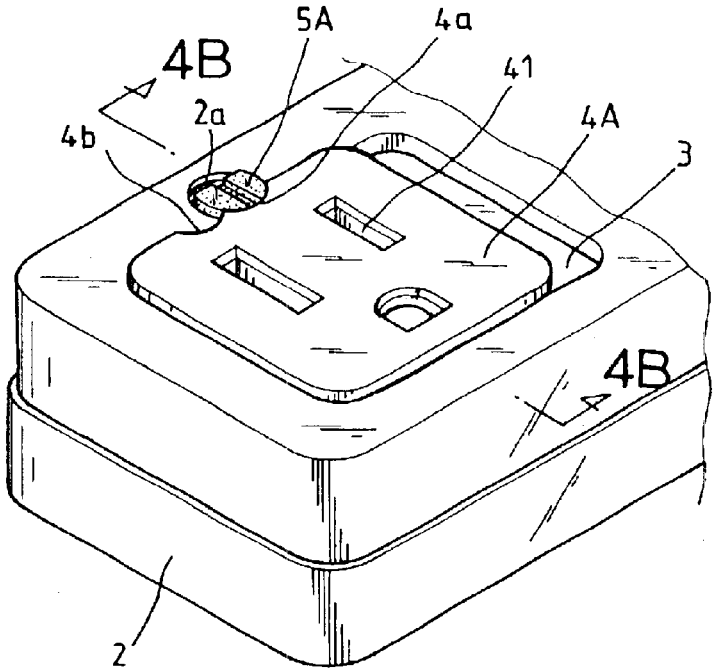
FIG. 4A is an elevational assembly view of FIG. 4.
Figure 4B:
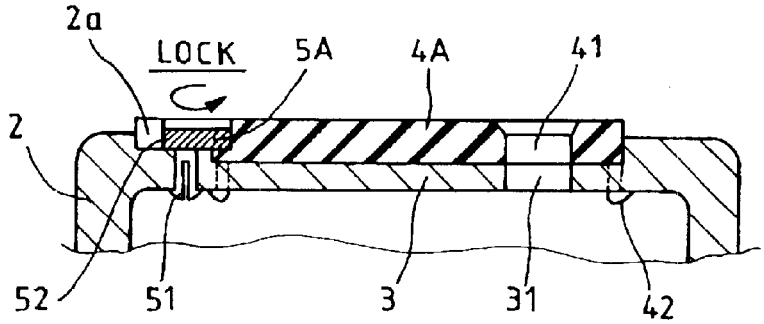
FIG. 4B is a sectional view of the embodiment of FIG. 4A, showing the locking bolt turned to the locking position.
Figure 4C:
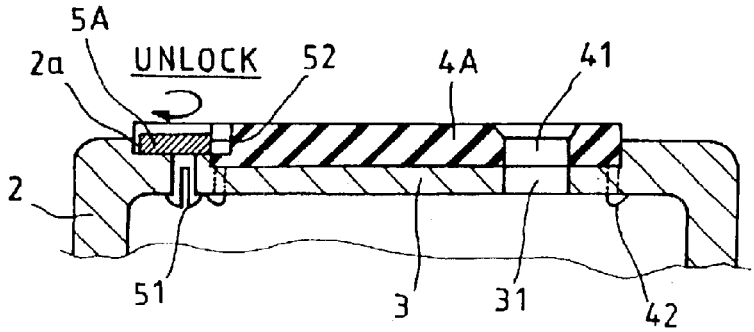
FIG. 4C is similar to FIG. 4B but showing the locking bolt turned to the unlocking position.
Figure 5A:
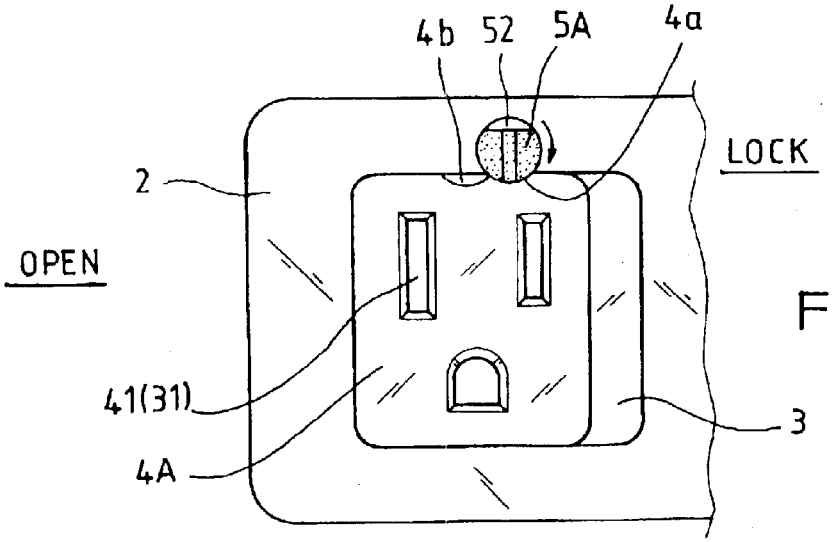
FIG. 5A is a schematic top view of the embodiment shown in FIG. 4D, showing the protective cover locked in the open position.
Figure 5B:
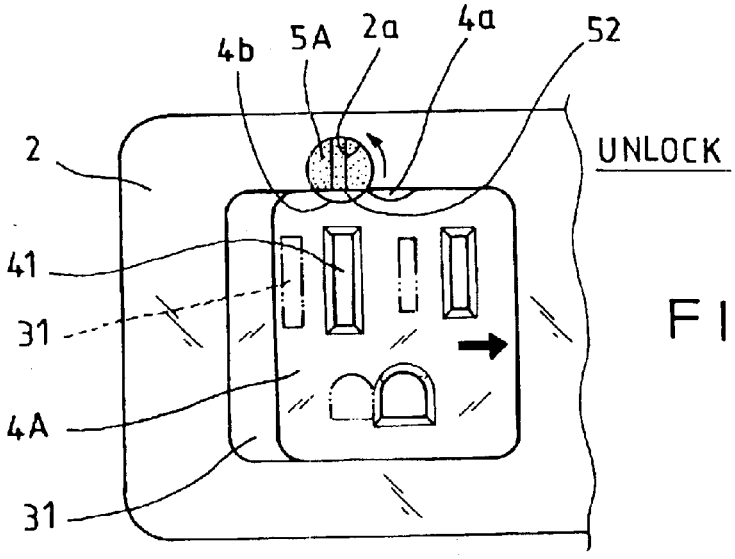
FIG. 5B is similar to FIG. 5A but showing the protective cover unlocked.
Figure 5C:
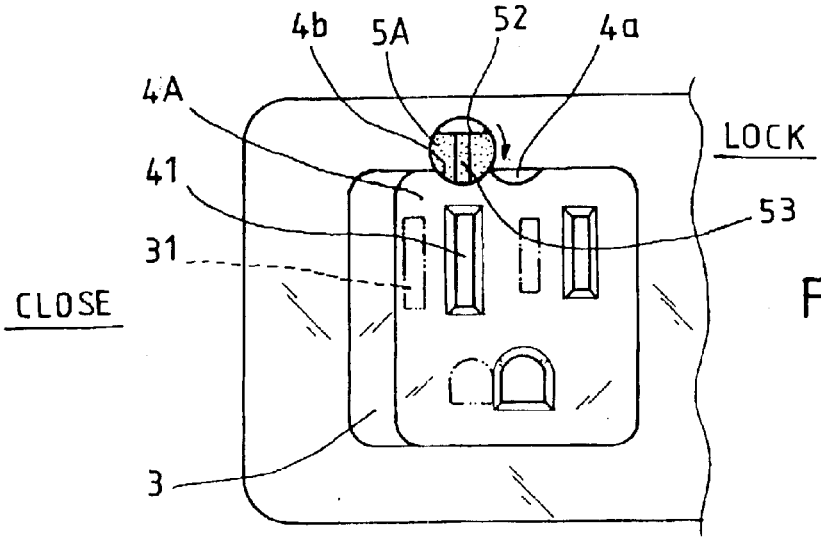
FIG. 5C is similar to FIG. 5B but showing the protective cover locked in the close position.

FIG. 4A shows the locking bolt 5A set in the notch 2*a* and engaging the first notch 3*a* of the protective cover 4A. FIG. 4B shows the cut edge 52 of the locking bolt 5A shifted to the outer side relative to the protective cover 4A, and the head 53 of the retaining bolt 5A engages the first notch 4*a* of the protective cover 4A to lock the protective cover 4A in the open position, at this time, the insertion slots 41 of the protective cover 4A are respectively aimed at the insertion slots 31 of the corresponding socket unit 3 (see FIG. 5A) so that an electric plug can be connected to the socket unit 3. When the locking bolt 5A rotated through 180° to shift the cut edge 52 to the inner side relative to the protective cover 4A as shown in FIG. 4C and FIG. 5B, the protective cover 4A is unlocked, and therefore the user can move the protective cover 4A between the close position and the open position. When the protective cover 4A moved to the close position as shown in FIG. 5C, the locking bolt 5A is rotated through 180° again to engage the second notch 4*b* of the protective cover 4A, and therefore the protective cover 4A is locked in the close position. According to this embodiment, the head 53 of the locking bolt 5A is a slotted head convenient for driving with a screwdriver or the like.

Figure 4D:
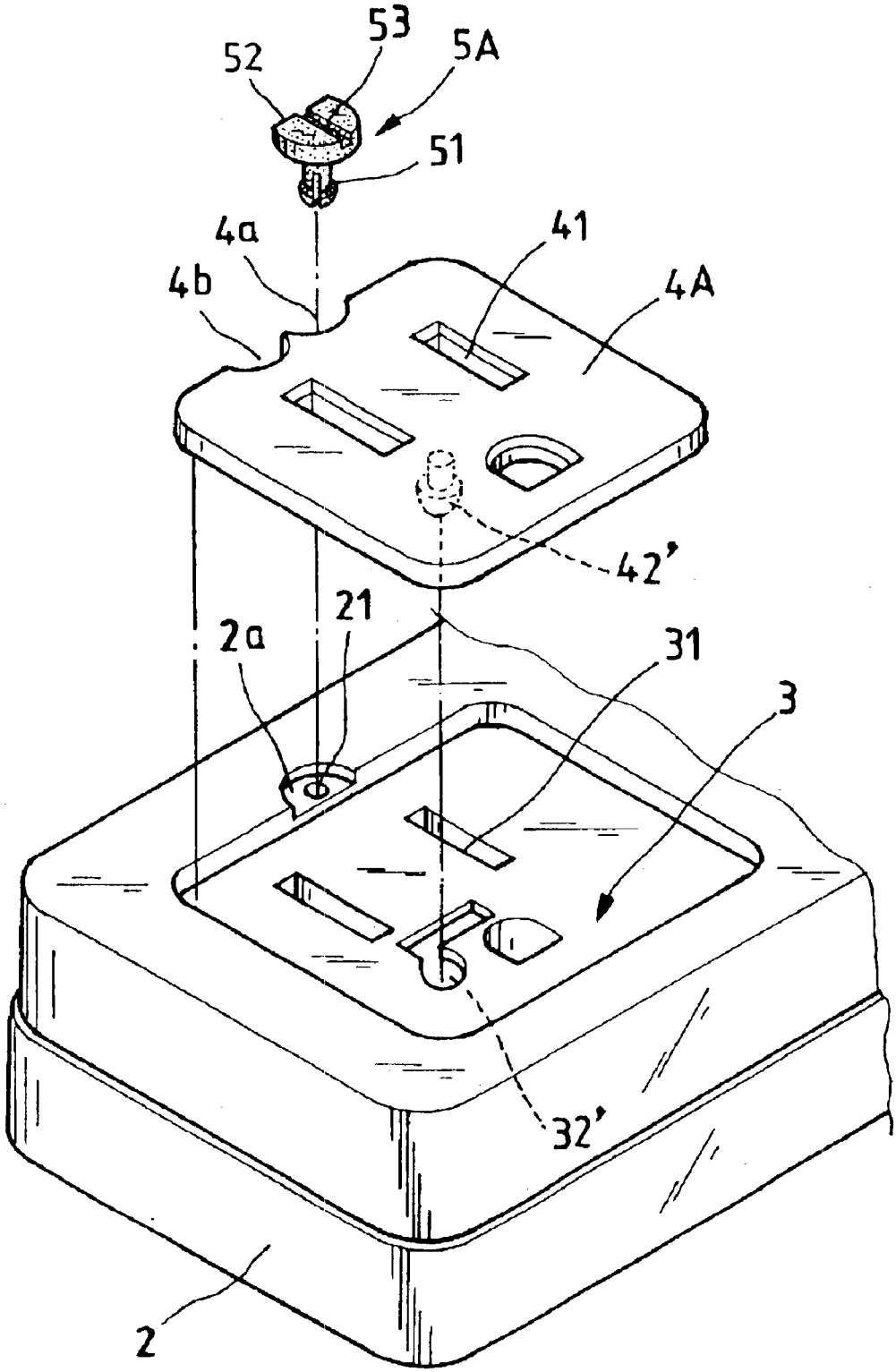
FIG. 4D is an exploded view of an alternate form of the protective cover and electric outlet arrangement according to the present invention.

FIG. 4D shows an alternate form of the present invention. This embodiment is similar to the embodiment shown in FIG. 4 with the exception of the coupling structure between the protective cover 4A and the socket unit 3. According to this embodiment, the protective cover 4A has a bottom bolt 42', and the socket unit 3 has a substantially L-shaped sliding slot 32', which receives the bottom bolt 42' of the protective cover 4A, for enabling the protective cover 4A to be moved on the socket unit 3 between the open position and the close position.

Figure 6:
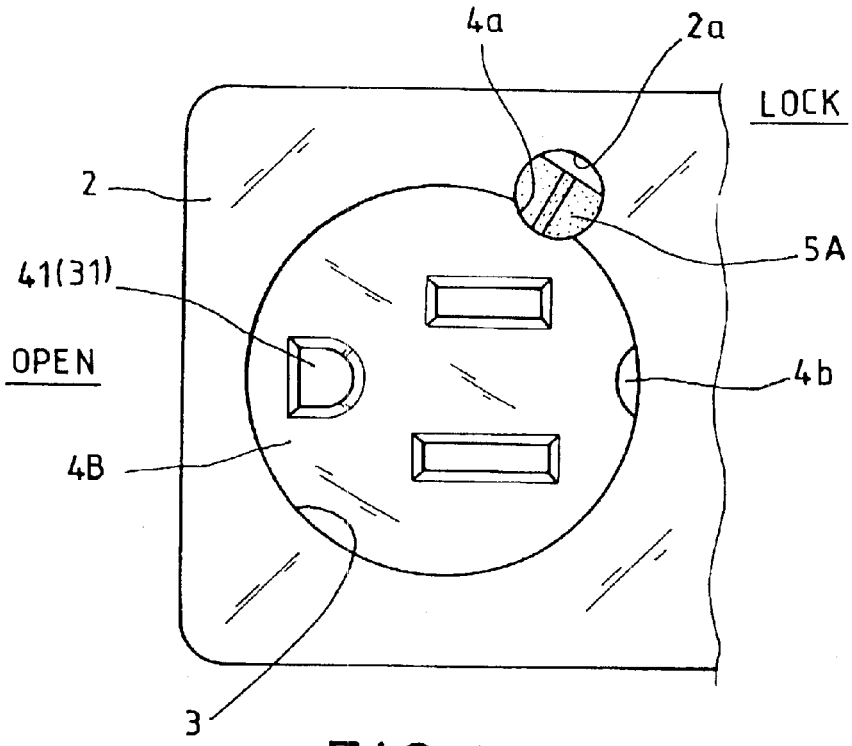
FIG. 6A is a top view of another alternate form of the protective cover and electric outlet arrangement according to the present invention.
FIG. 6B is similar to FIG. 6A but showing the protective cover locked in the close position.
Figure 6:
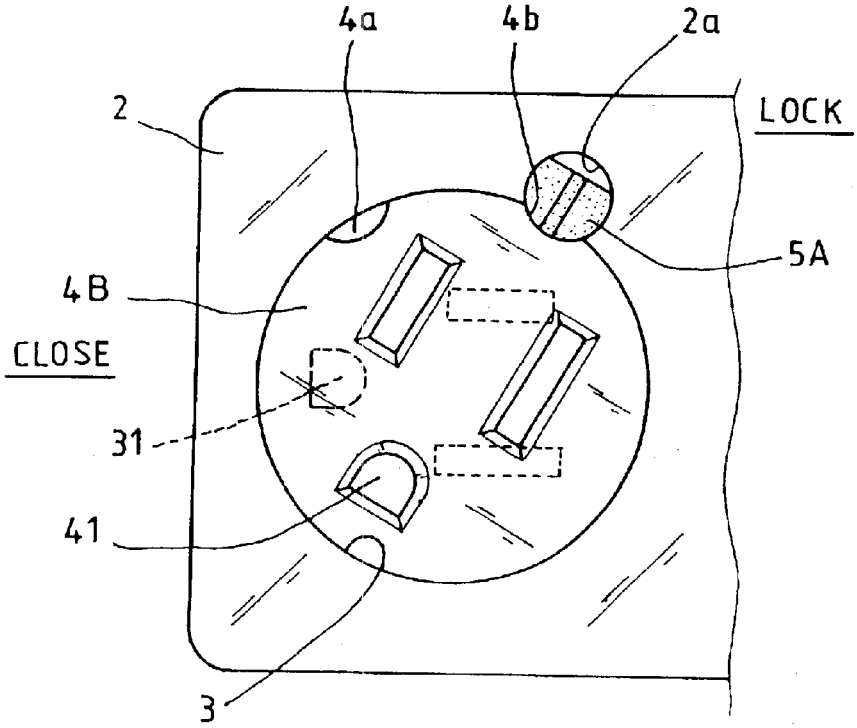

FIGS. 6A and 6B show another alternate form of the present invention. According to this embodiment, the protective cover 4A is a circular cover plate fastened pivotally with the outlet body, and can be rotated on the corresponding socket unit 3 between the open position as shown in FIG. 6A and the close position as shown in FIG. 6B. When rotated to the open or close position, the locking bolt 5A is rotated to the locking position to lock the protective cover 4A.

Figure 7:
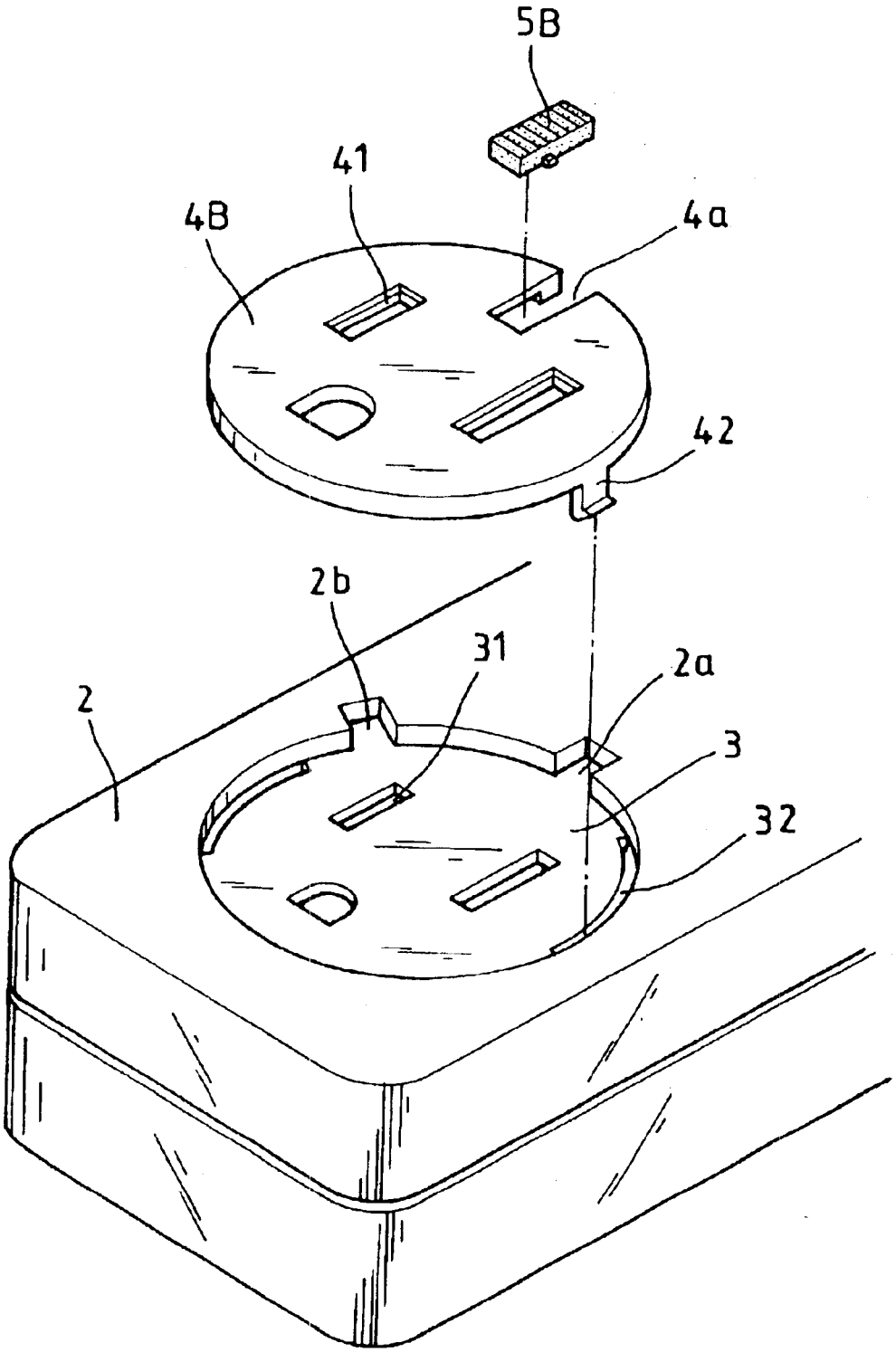
FIG. 7 is an exploded view of still another alternate form of the protective cover and electric outlet arrangement according to the present invention.
Figure 7A:
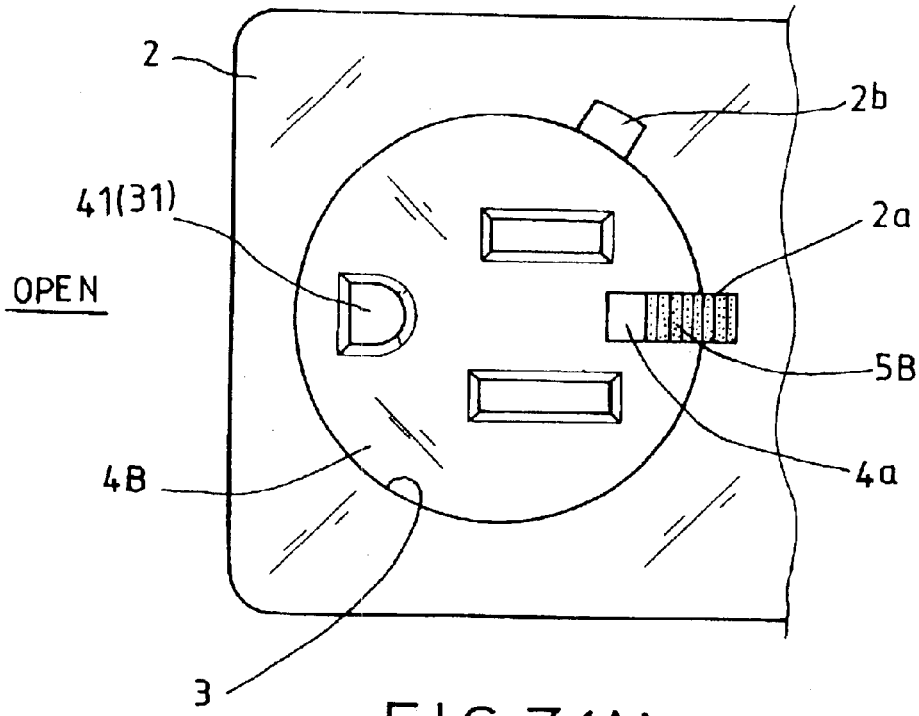
FIG. 7A is a top view of the embodiment shown in FIG. 7, showing the protective cover locked in the open position.
Figure 7B:
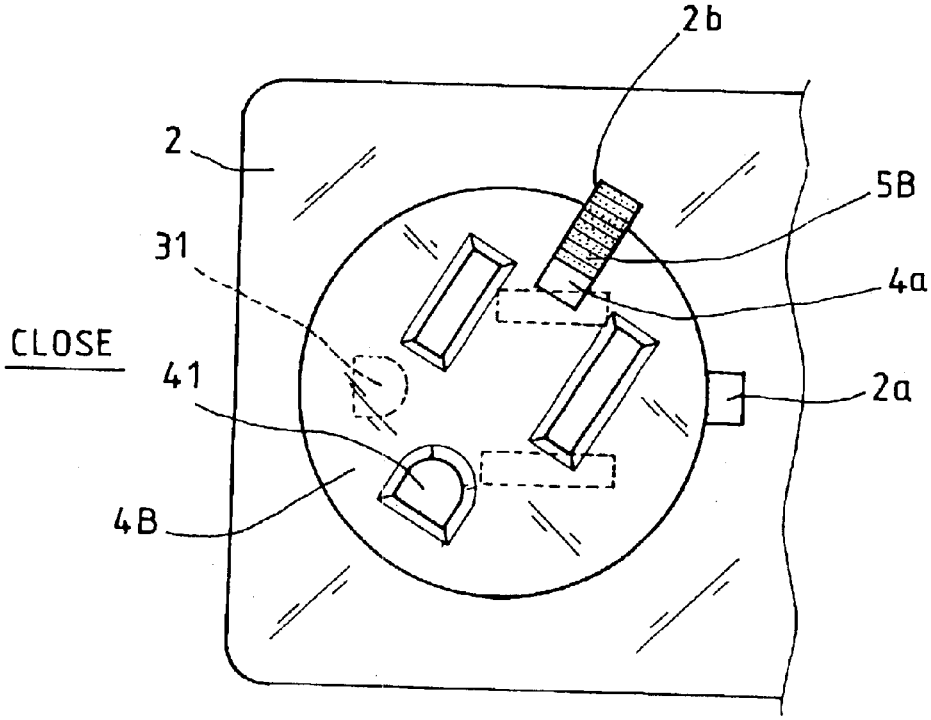
FIG. 7B is a top plain view of the embodiment shown in FIG. 7, showing the protective cover locked in the close position.

FIGS. 7, 7A and 7B show still another alternate form of the present invention. According to this embodiment, the circular protective cover 4B has only one notch 4*a*, which is extended in a radial direction, and a locking latch 5B is coupled to the protective cover 4B and moved in and out of the notch 4*a*. When the locking latch 5B moved inside the notch 4*a*, the protective cover 41 is unlocked and can be rotated between the open position as shown in FIG. 7A and the close position as shown in FIG. 7B. When the protective cover 4B turned to the open/close position, the locking latch 5B is moved out of the notch 4*a* and partially engaged into the first notch 2*a* (or second notch 2*b*) to lock the protective cover 4B in the close (or open) position.

Figure 7C:
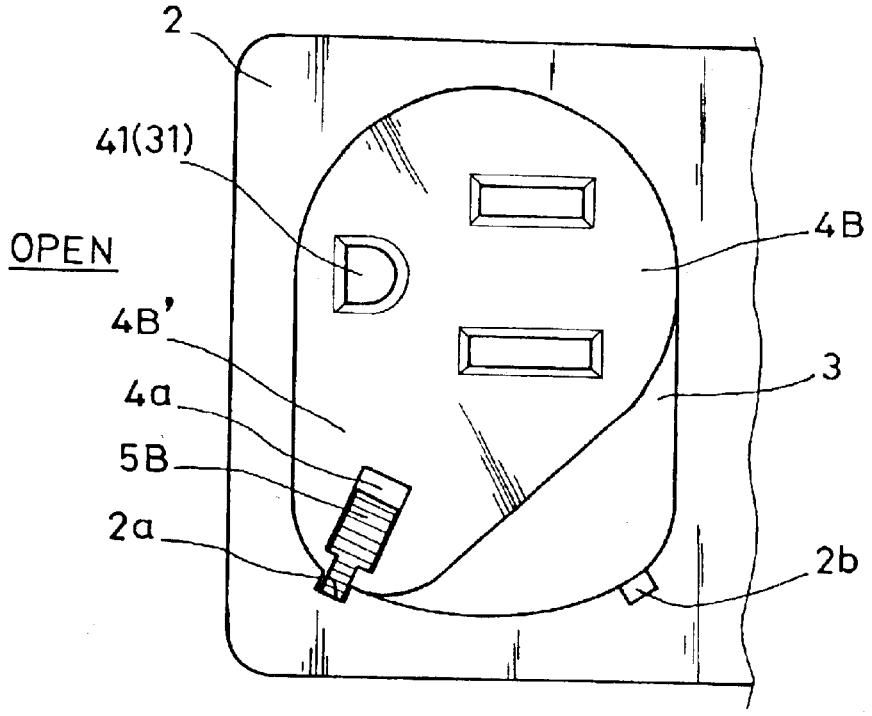
FIG. 7C is a top view of still another alternate form of the protective cover and electric outlet arrangement according to the present invention, showing the protective cover locked in the open position.
Figure 7D:
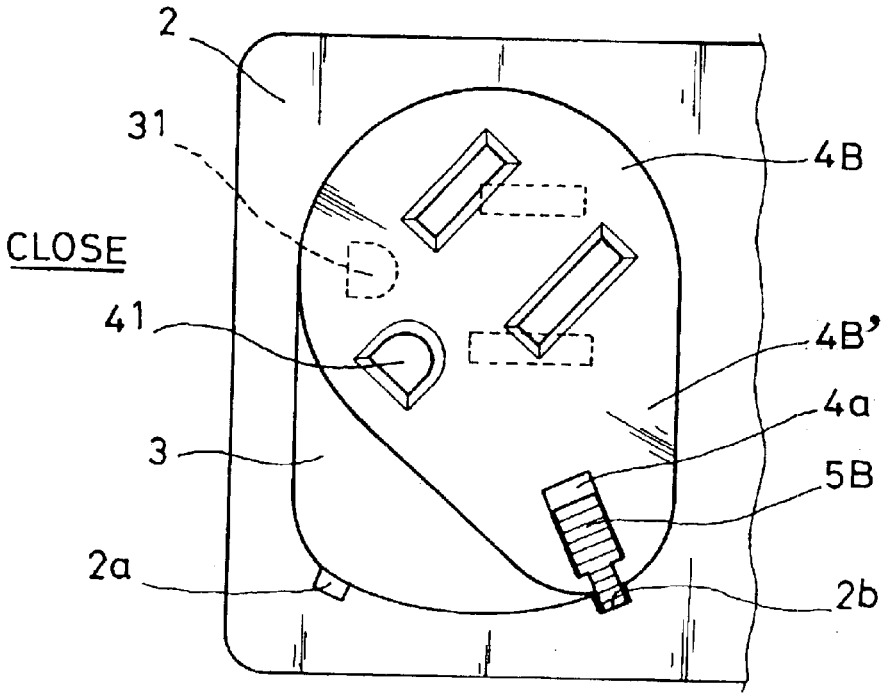
FIG. 7D is similar to FIG. 7C but showing the protective cover locked in the close position.

FIGS. 7C and 7D show still another alternate form of the present invention. This embodiment is similar to the embodiment shown in FIG. 7 with the exception of the shape of the protective cover 4B. According to this embodiment, the protective cover has a protruded extension portion 4B', and the locking latch 5B is moved in and out of the notch 4*b* for selectively engaging the first notch 2*a* or second notch 2*b* in the corresponding socket unit 3 of the outlet body 2 to lock/unlock the protective cover 4B.

Figure 8A:
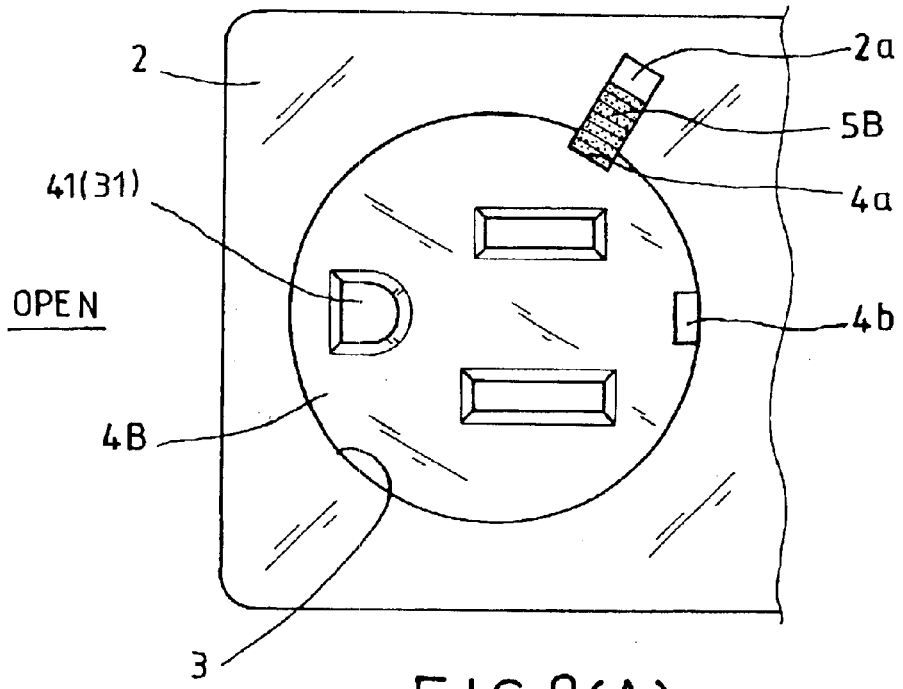
FIG. 8A is a top view of still another alternate form of the protective cover and electric outlet arrangement according to the present invention, showing the protective cover locked in the open position.
Figure 8B:
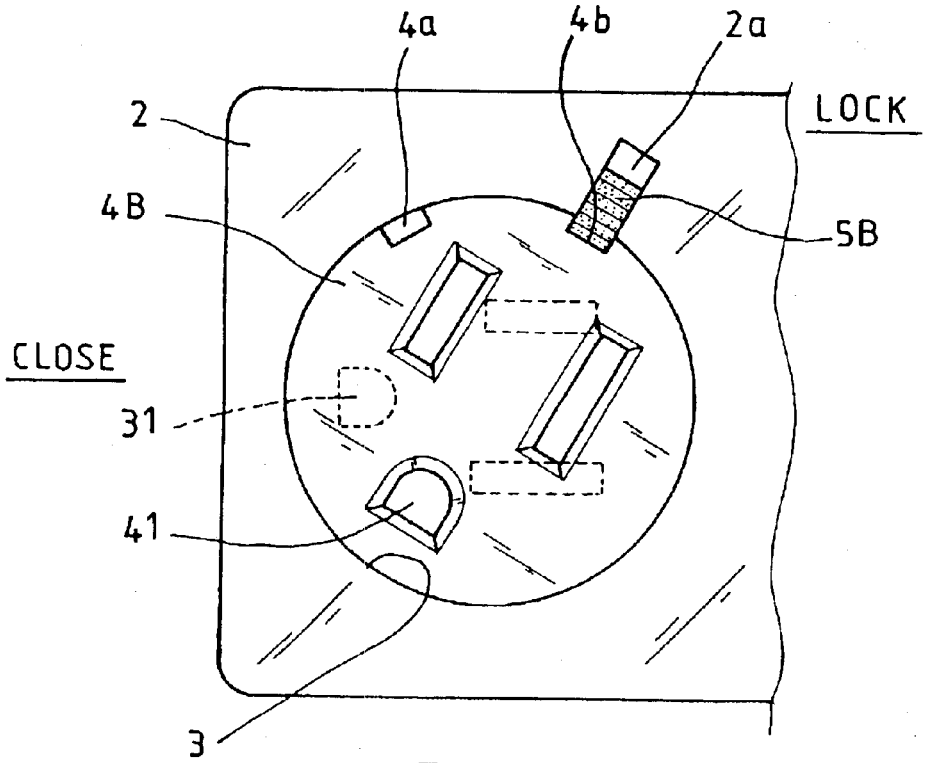
FIG. 8B is similar to FIG. 8A but showing the protective cover locked in the close position.

FIGS. 8A and 8B show still another alternate form of the present invention. According to this embodiment, the locking latch 5B is coupled to the socket unit 2 and moved in and out of the notch 2*a* of the socket unit 2 for selectively engaging in the first notch 4*a* or second notch 4*b* of the protective cover 4B to selectively lock the protective cover 4B in the open or close position.

Figure 9:
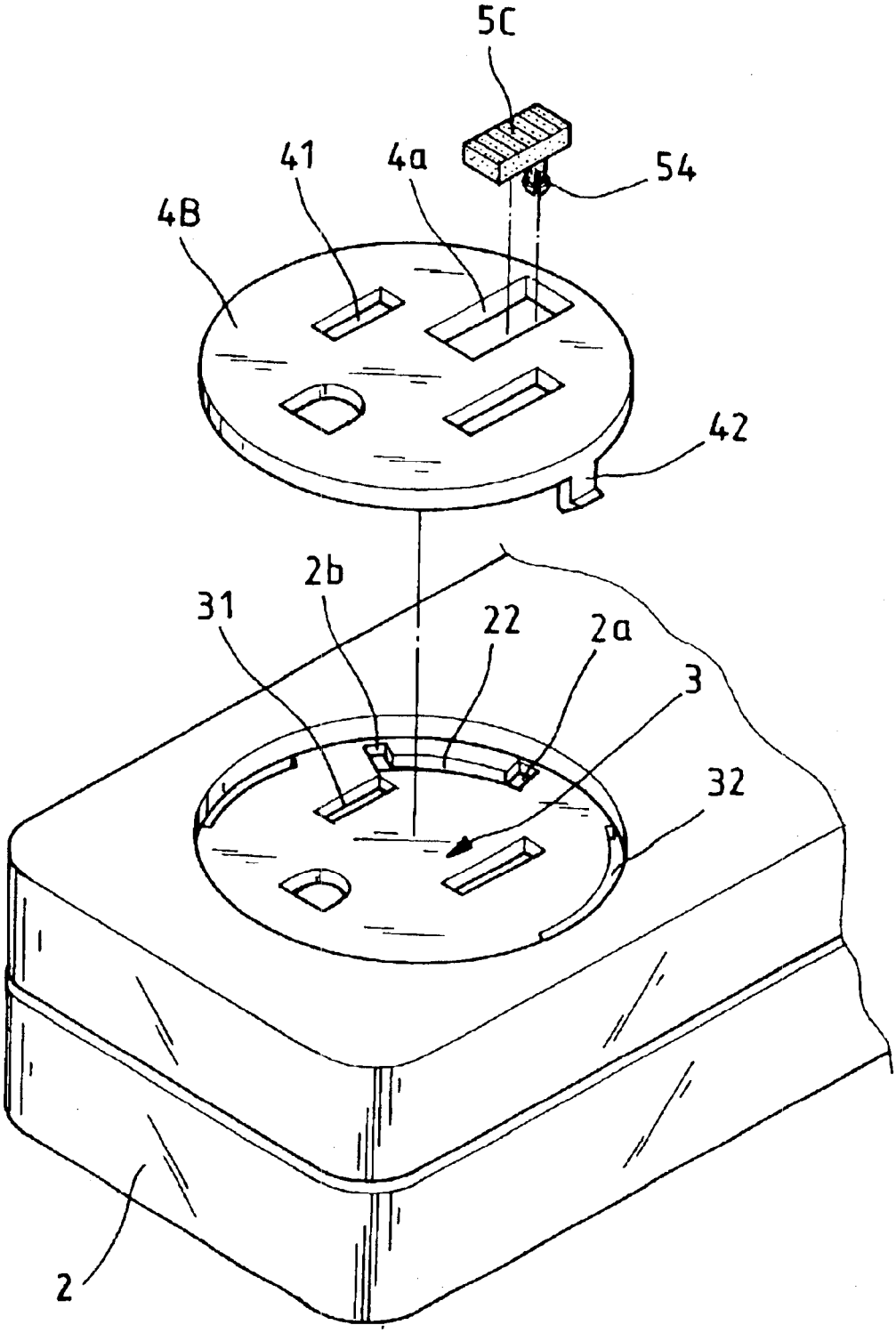
FIG. 9 is an exploded view of still another alternate form of the present invention.
Figure 10A:
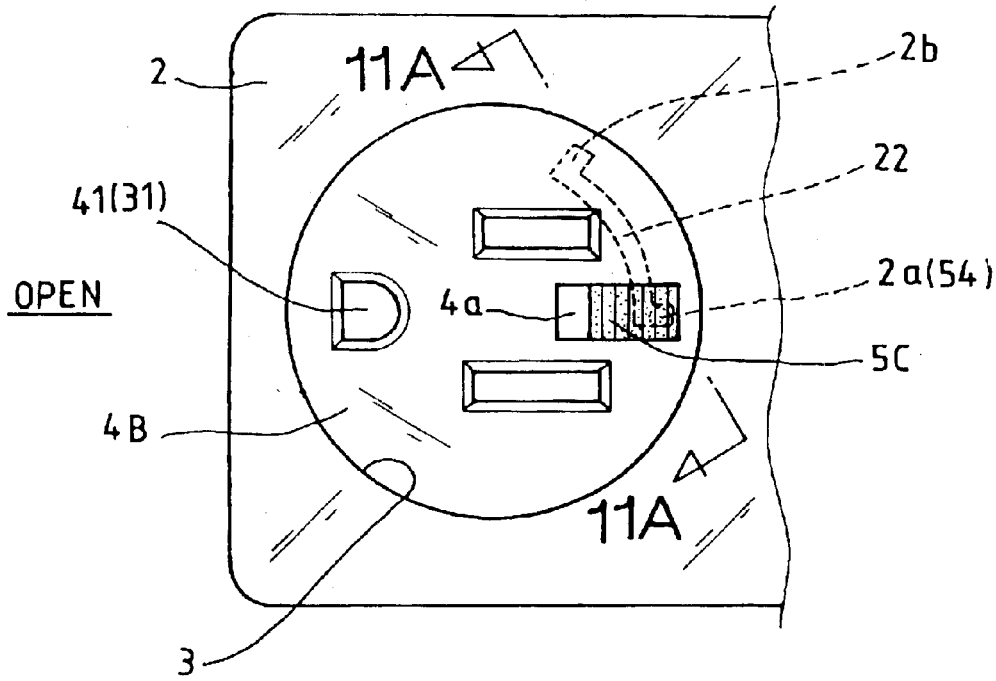
FIG. 10A is a top plain view of the embodiment shown in FIG. 9, showing the protective cover locked in the open position.
Figure 10B:
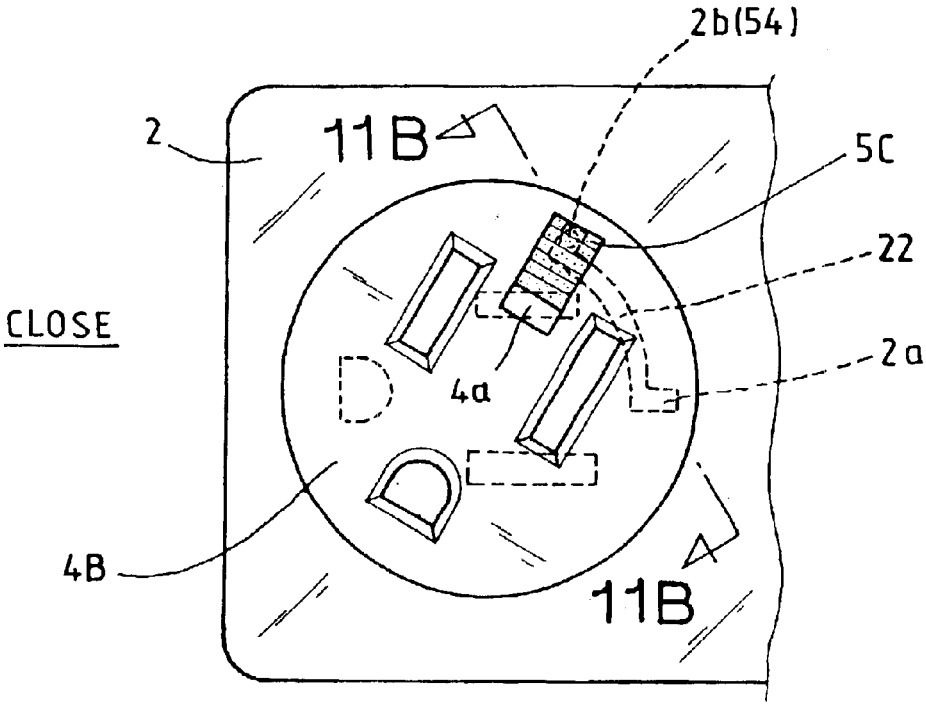
FIG. 10B is a top plain view of the embodiment shown in FIG. 9, showing the protective cover locked in the close position.
Figure 11A:
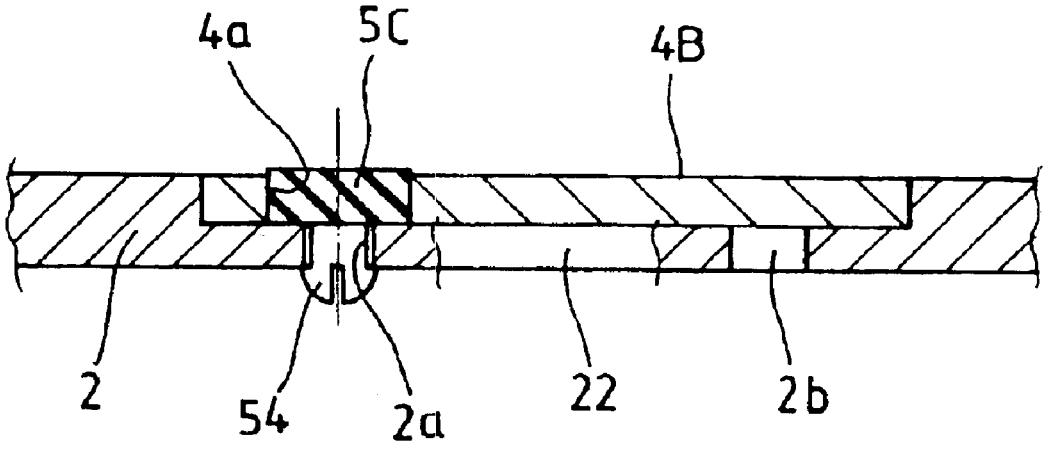
FIG. 11A is a sectional view taken along line 11A—11A of FIG. 10A.
Figure 11B:
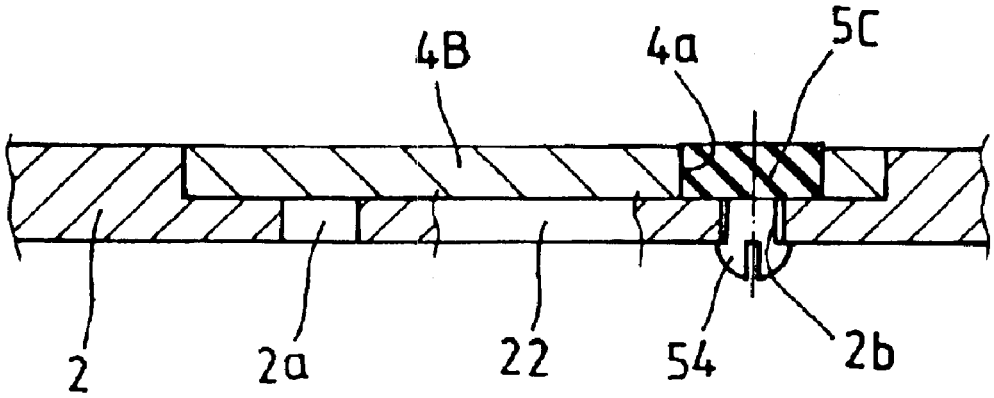
FIG. 11B is a sectional view taken along line 11B—11B of FIG. 10B.

FIG. 9 shows still another alternate form of the present invention. According to this embodiment, the socket unit 3 has a first notch 2*a*, a second notch 2*b*, and a groove 22 connected between the first notch 2*a* and the second notch 2*b*; a sliding locking member 5C is coupled to the protective cover 4B and moved in the notch 4*a* of the protective cover 4B between the locking position where the bottom locking rod 54 is engaged into the first notch 2*a* (see FIGS. 10A and 11A) or second notch 2*b* (see FIGS. 10B and 11B) of the socket unit 3 to lock the protective cover 4B in the open or close position, and the unlocking position where the bottom locking rod 54 is disengaged from the notches 2*a* and 2*b* and suspended in the groove 22.

Figure 12:
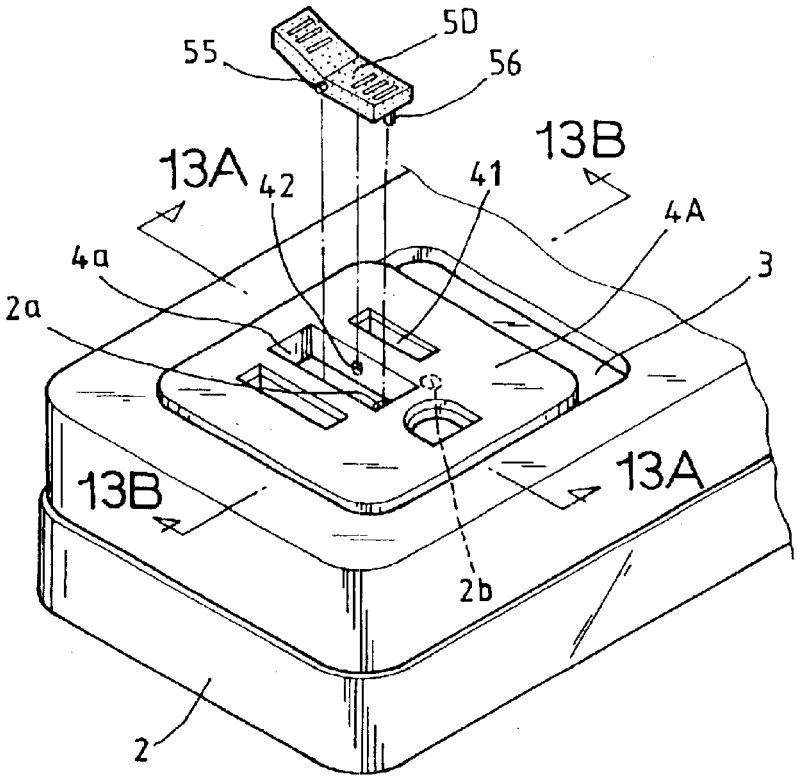
FIG. 12 is an exploded view of still another alternate form of the protective cover and electric outlet arrangement according to the present invention.
Figure 13A:
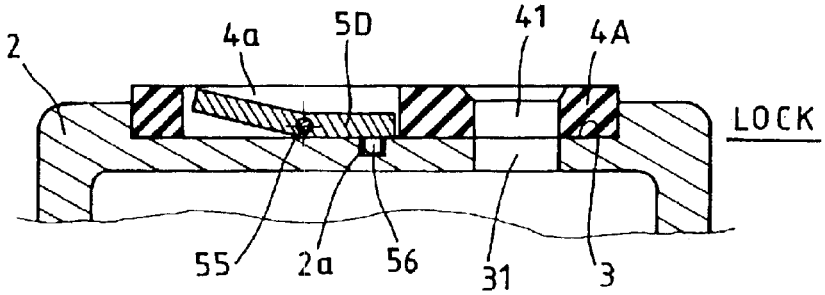
FIG. 13A is a sectional view of the embodiment shown in FIG. 12, showing the seesaw switching lever switched to the locking position.
Figure 13:
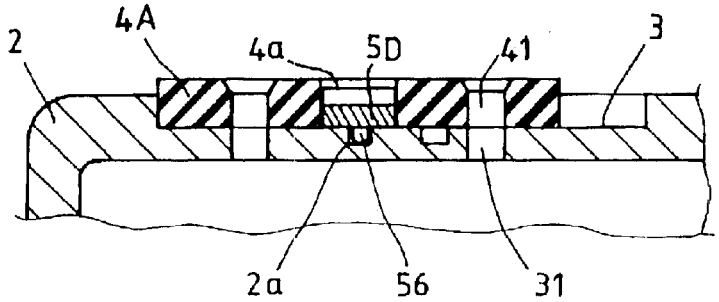
FIG. 13B is a sectional view of the embodiment shown in FIG. 12 taken in another direction, showing the seesaw switching lever switched to the locking position.
FIG. 13C is a sectional view of the embodiment shown in FIG. 12, showing the seesaw switching lever switched to the unlocking position.
FIG. 13D is a sectional view of the embodiment shown in FIG. 12 taken in another direction, showing the seesaw switching lever switched to the unlocking position.
Figure 13C:
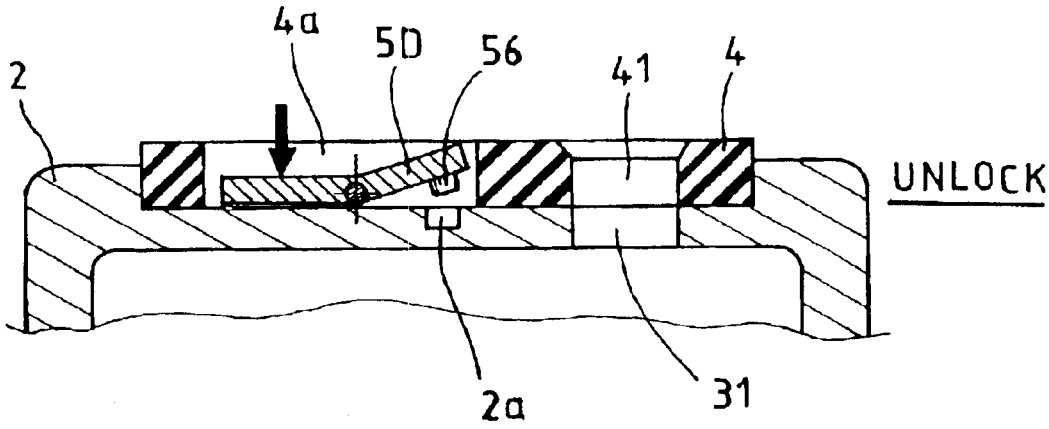
Figure 13D:
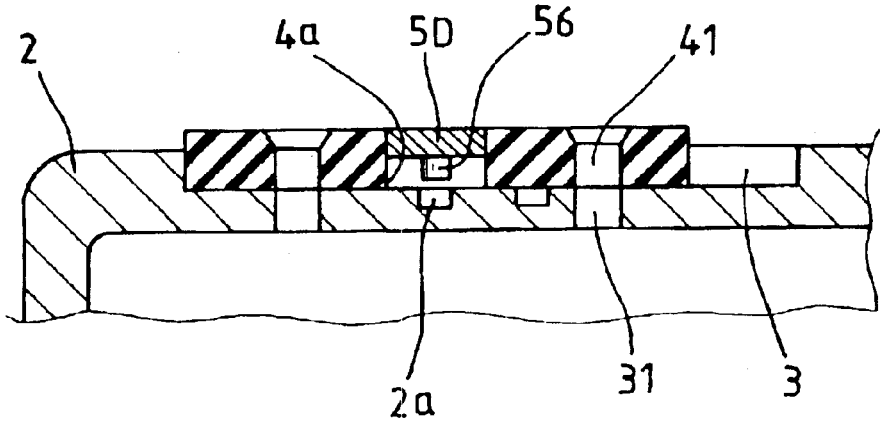
Figure 14A:
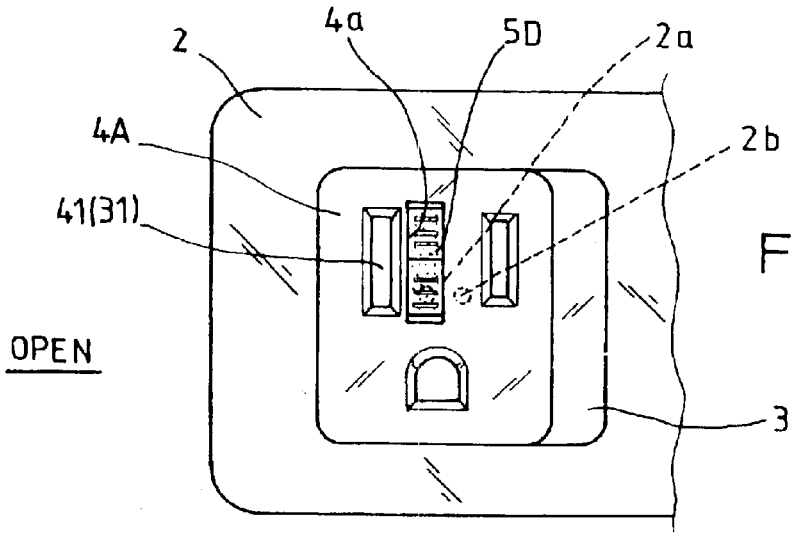
FIG. 14A is a top view of still another alternate form of the protective cover and electric outlet arrangement according to the present invention.
Figure 14B:
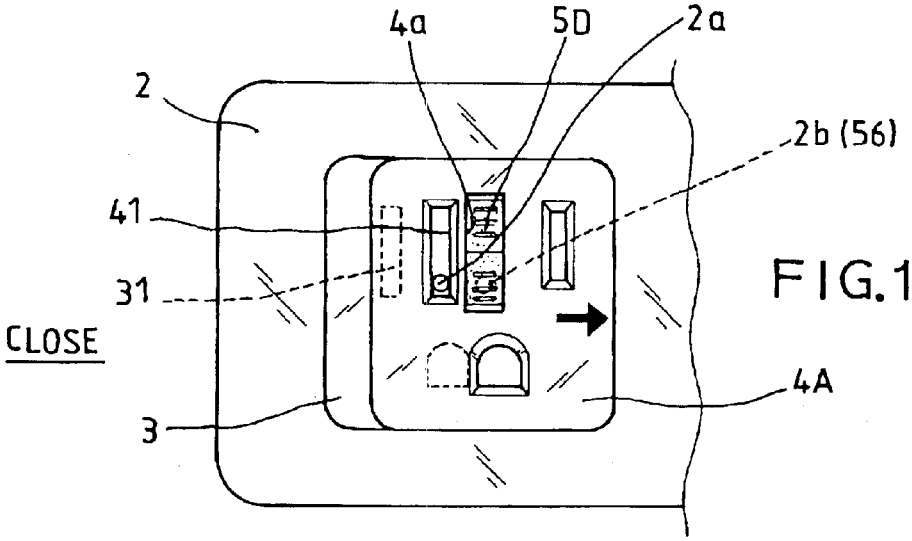
FIG. 14B is similar to FIG. 14A but showing protective cover moved to the close position.

FIG. 12 shows still another alternate form of the present invention. According to this embodiment, the socket unit 3 has a first notch 2*a* and a second notch 2*b*; a seesaw switching lever 5D is fastened pivotally with the protective cover 4B for locking the protective cover 4B between the close position and the open position. The seesaw switching lever has two pivot pins 55 symmetrically provided at two sides on the middle and respectively pivoted to a respective pivot hole 42 in the notch 4*a* of the protective cover 4A, and a retaining rod 56 downwardly extended from the bottom wall near one end for engaging in the first notch 2*a* or second notch 2*b* in the top side of the socket unit 3. FIGS. 13A and 13B show the seesaw switching lever 5D switched to the locking position to lock the protective cover 4A. FIGS. 13C and 13D show the seesaw switching lever 5D switched to the unlocking position. FIG. 14A shows the protective cover 4A locked in the open position. FIG. 14B shows the protective cover 4A unlocked and moved to the close position.

Figure 15:
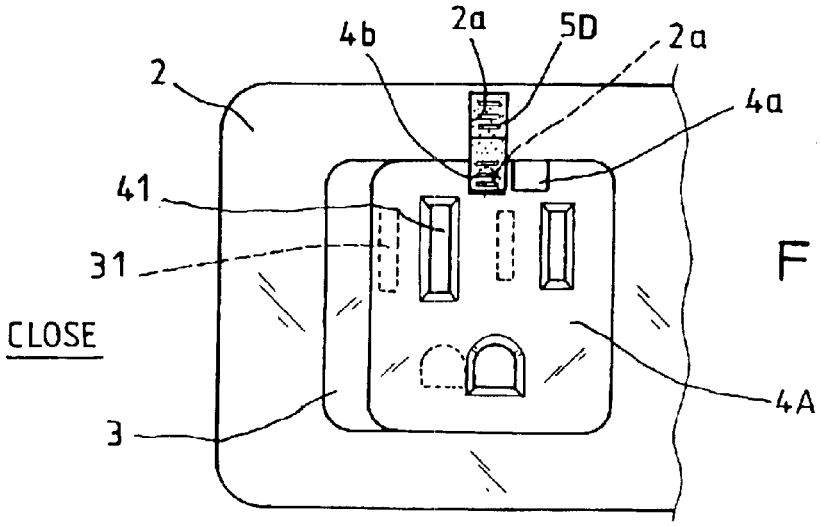
FIG. 15 is similar to FIG. 14B but showing the seesaw switching lever turned to the locking position.

FIG. 15 shows still another alternate form of the present invention. According to this embodiment, the seesaw switching lever 5D is pivoted to the notch 2*a* in the outlet body 2, and selectively engaged in the first notch 4*a* or second notch 4*b* of the protective cover 4A to lock the protective cover 4A in the close or open position.

A prototype of protective cover and electric outlet arrangement has been constructed within the features of FIGS. 4~15. The protective cover and electric outlet arrangement functions smoothly to provide all the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A protective cover and electric outlet arrangement comprising:

an outlet body, said outlet body comprising a socket unit, said socket unit having a plurality of insertion holes adapted to receive an electric plug;

a protective cover coupled to said outlet body and angularly displaceable relative to said outlet body between an open position for opening access to the insertion holes of said socket unit and a closed position for closing access to the insertion holes of said socket unit;

a locking structure adapted to selectively lock said protective cover in said open position or said closed position;

wherein said locking structure comprises:

at least one main notch formed in one of said outlet body and protective cover, and at least first and second notches formed in the other of said outlet body and protective cover for alternatively aligning with said main notch in respective ones of said open and closed positions;

a locking member disposed in said main notch and displaceable to engage one of said first and second notches to lock said protective cover.

2. The protective cover and electric outlet arrangement as claimed in claim 1, wherein said protective cover is fastened pivotally to said outlet body for rotation relative to said socket unit between said closed position and said open position.

3. The protective cover and electric outlet arrangement as claimed in claim 1, wherein said locking member is a locking latch coupled to said protective cover and reversibly moved to extend from said main notch of said protective cover for selectively engaging a said first and second notches in said outlet body.

4. The protective cover and electric outlet arrangement as claimed in claim 1, wherein said locking member is a locking latch coupled to said outlet body and reversibly moved to extend from said main notch in said outlet body for selectively engaging said first and second notches in said protective cover.

5. The protective cover and electric outlet arrangement as claimed in claim 1, wherein said locking member is coupled to said protective cover and reversibly movable within said main notch of said protective cover, said locking member having a bottom locking rod extending therefrom for selectively engaging said first notch of said outlet body when said protective cover is moved to said open position and said second notch of said outlet body when said protective cover is moved to said closed.

* * * * *